US006929527B1

(12) United States Patent
Chan

(10) Patent No.: US 6,929,527 B1
(45) Date of Patent: Aug. 16, 2005

(54) DOLL AND INFRASTRUCTURE THEREIN

(75) Inventor: Chung Nin Danny Chan, Clearwater Bay (HK)

(73) Assignee: Lotus Onda Industrial Co. Ltd., (HK)

( * ) Notice: Subject to any disclaimer, the term of this patent is extended or adjusted under 35 U.S.C. 154(b) by 0 days.

(21) Appl. No.: 10/798,035

(22) Filed: Mar. 11, 2004

(51) Int. Cl.[7] ..... A63H 3/02; A63H 3/46
(52) U.S. Cl. ..... 446/369; 446/370; 446/376
(58) Field of Search ..... 446/376, 356, 446/370, 378, 369, 373, 374, 375, 377

(56) References Cited

U.S. PATENT DOCUMENTS

| | | | | | |
|---|---|---|---|---|---|
| 4,006,555 | A | * | 2/1977 | England et al. | 446/219 |
| 4,790,789 | A | * | 12/1988 | Mathis | 446/378 |
| 4,954,118 | A | | 9/1990 | Refabert | |
| 5,017,173 | A | | 5/1991 | Shapero et al. | |
| 5,045,015 | A | * | 9/1991 | Arad et al. | 446/355 |
| 5,478,514 | A | | 12/1995 | Hamilton | |
| 5,580,295 | A | * | 12/1996 | Ruzskai et al. | 446/378 |
| 5,620,352 | A | | 4/1997 | Tzong | |
| 5,630,745 | A | | 5/1997 | Yeh | |
| 5,769,681 | A | * | 6/1998 | Greenwood et al. | 446/120 |
| 6,033,284 | A | * | 3/2000 | Rodriguez Ferre | 446/383 |
| 6,074,270 | A | * | 6/2000 | Wilcox et al. | 446/370 |
| 6,217,406 | B1 | * | 4/2001 | Ross | 446/370 |
| 6,224,456 | B1 | * | 5/2001 | Wittenberg | 446/330 |
| 6,368,178 | B1 | * | 4/2002 | Berman | 446/420 |
| 6,482,068 | B2 | * | 11/2002 | Lee et al. | 446/376 |
| 6,494,763 | B1 | | 12/2002 | Hastey | |
| 2002/0002022 | A1 | | 1/2002 | Wilcox et al. | |
| 2003/0092354 | A1 | | 5/2003 | Wexler | |
| 2003/0119418 | A1 | * | 6/2003 | Langton | 446/373 |

* cited by examiner

*Primary Examiner*—Derris H. Banks
*Assistant Examiner*—Faye Francis
(74) *Attorney, Agent, or Firm*—Keusey, Tutunjian & Bitetto, P.C.

(57) ABSTRACT

A joint for use in toys, such as dolls, includes a first member including at least a portion of a ball and a second member including a socket which receives the at least a portion of the ball. A protrusion is formed on the first member adjacent to the ball such that when the ball is received in the socket a rotation about a longitudinal axis of the first member is permitted while at least partially restricting bending in a plane of the longitudinal axis.

13 Claims, 6 Drawing Sheets

DOLL AND INFRASTRUCTURE THEREIN

FIELD OF THE INVENTION

The present invention generally relates to infrastructure for dolls and more particularly to joint structures for dolls and toys.

BACKGROUND OF THE INVENTION

Many doll skeleton include pivot joints for arms legs, shoulder and hips for dolls. In some instances these joints are simple hinges. Hinges provide limited motion and do not permit rotation relative to the longitudinal axis of a member to which the joint is attached. In some cases these joints have an additional rotational joint, which contributes to the degrees of freedom of the connection but creates an arbitrary and unnatural motion.

In other structures, linkages are employed which include a series of ball and socket joints. These provide sufficient flexibility to arms and legs of the doll, but don not limit the movement of these appendages when they are extended beyond natural ranges of motion. This is particularly true for structures including these ball and socket joints for the spine or backbone of the doll. Ball and socket joints employed in the backbone can often lead to unnatural contorsions not normally possible in humans.

Therefore, a need exists for a skeletal structure for dolls and toys, which limits motion of at least the backbone to provide a more natural motion for the doll or toy.

SUMMARY OF THE INVENTION

A joint for use in toys, such as dolls, includes a first member including at least a portion of a ball and a second member including a socket which receives the at least a portion of the ball. A protrusion is formed on the first member adjacent to the ball such that when the ball is received in the socket a rotation about a longitudinal axis of the first member is permitted while at least partially restricting bending in a plane of the longitudinal axis.

The first member may include longitudinal grooves, and the second member may include longitudinal grooves.

BRIEF DESCRIPTION OF THE DRAWINGS

The advantages, nature, and various additional features of the invention will appear more fully upon consideration of the illustrative embodiments now to be described in detail in connection with accompanying drawings wherein.

It should be understood that the drawings are for purposes of illustrating the concepts of the invention and are not necessarily the only possible configuration for illustrating the invention.

DETAILED DESCRIPTION OF PREFERRED EMBODIMENTS

The present invention provides infrastructures for toys and/or dolls having a joint or connection, which includes a natural range of motion and flexibility. In one embodiment, a backbone for an infrastructure includes a first compliant member having a first spherical portion formed thereon. An annular ring is formed adjacent to the first spherical structure at or near the connection point between the first spherical portion and the first member. A second member includes a hollow second spherical portion adapted to receive the first spherical member. The second spherical portion is permitted to rotate relative to the first spherical portion, and is limited by the annular ring. Further limitations on the relative motion may include a limit to the relation rotation between the spherical portions. This may be performed by adding tabs and slots in the respective members. In this way, a more natural range of motion is achieved while providing sufficient strength and flexibility in the infrastructure.

It is to be understood that the present invention is described in terms of a doll infrastructure. However, the present invention is broader and includes all dolls, stuffed animals, action figures or any other device or toy.

Figures 1, 1A:
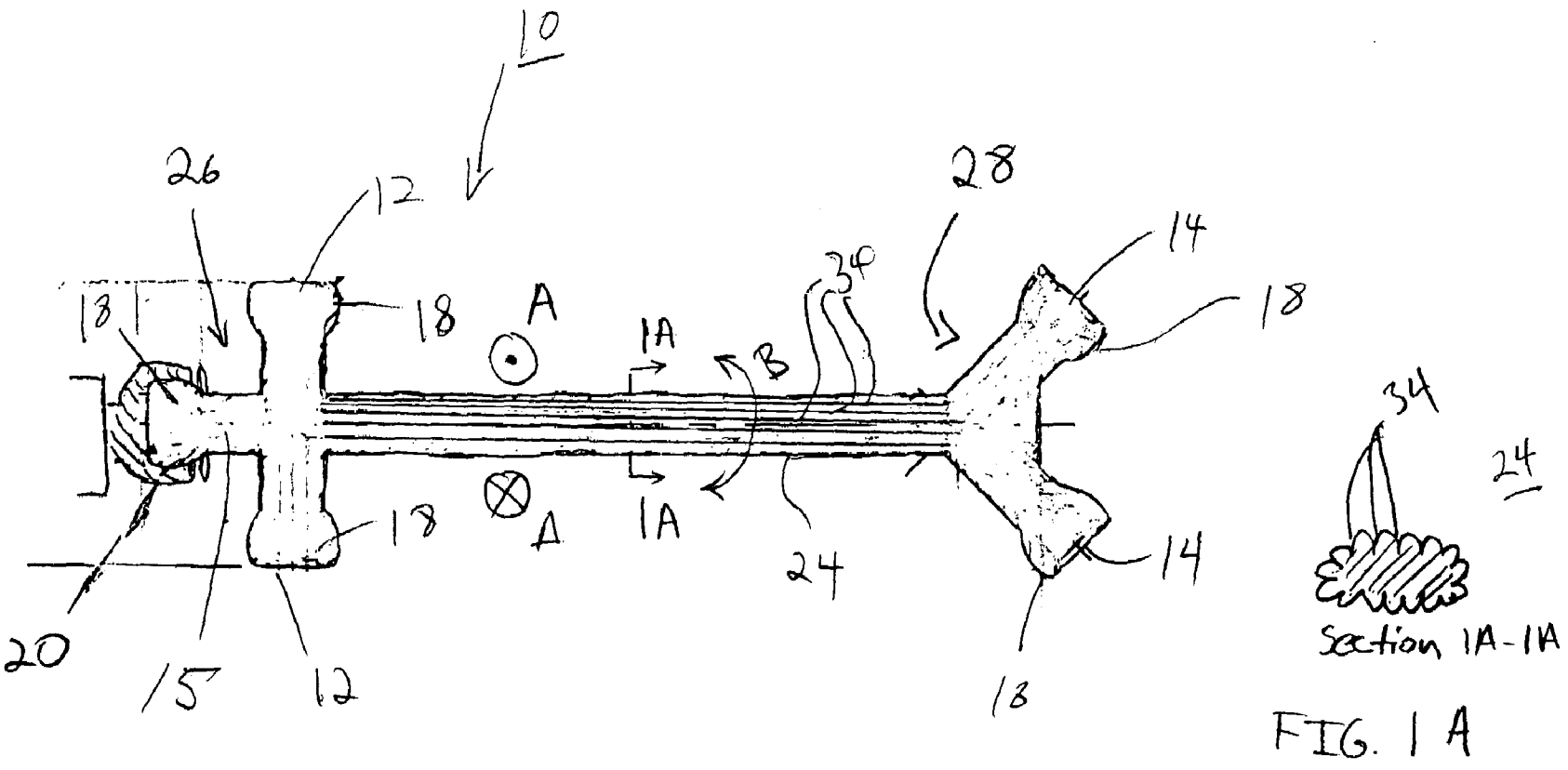
FIG. 1 is an exemplary backbone portion of a toy skeleton in accordance with one embodiment of the present invention.
FIG. 1A is a cross-sectional view taken at section line 1A—1A of FIG. 1.

Referring now in specific detail to the drawings in which like reference numerals identify similar or identical elements throughout the several views, and initially to FIG. 1, a skeleton portion or backbone 10 is illustratively depicted for a human doll. Backbone 10 includes connections for arms 12 and legs 14. Connections for arms 12 and legs 14 are preferably integrally formed with a spine 24. Connections 12 and 14 may be connected to links (not shown), which may be the same length or variable lengths. Each link may include a ball end and a socket end, which would correspond with a ball end 18 or a socket end 20 on backbone 10. FIG. 1 depicts ball ends 18 with a socket end connected to a neck portion 15.

Figure 6:
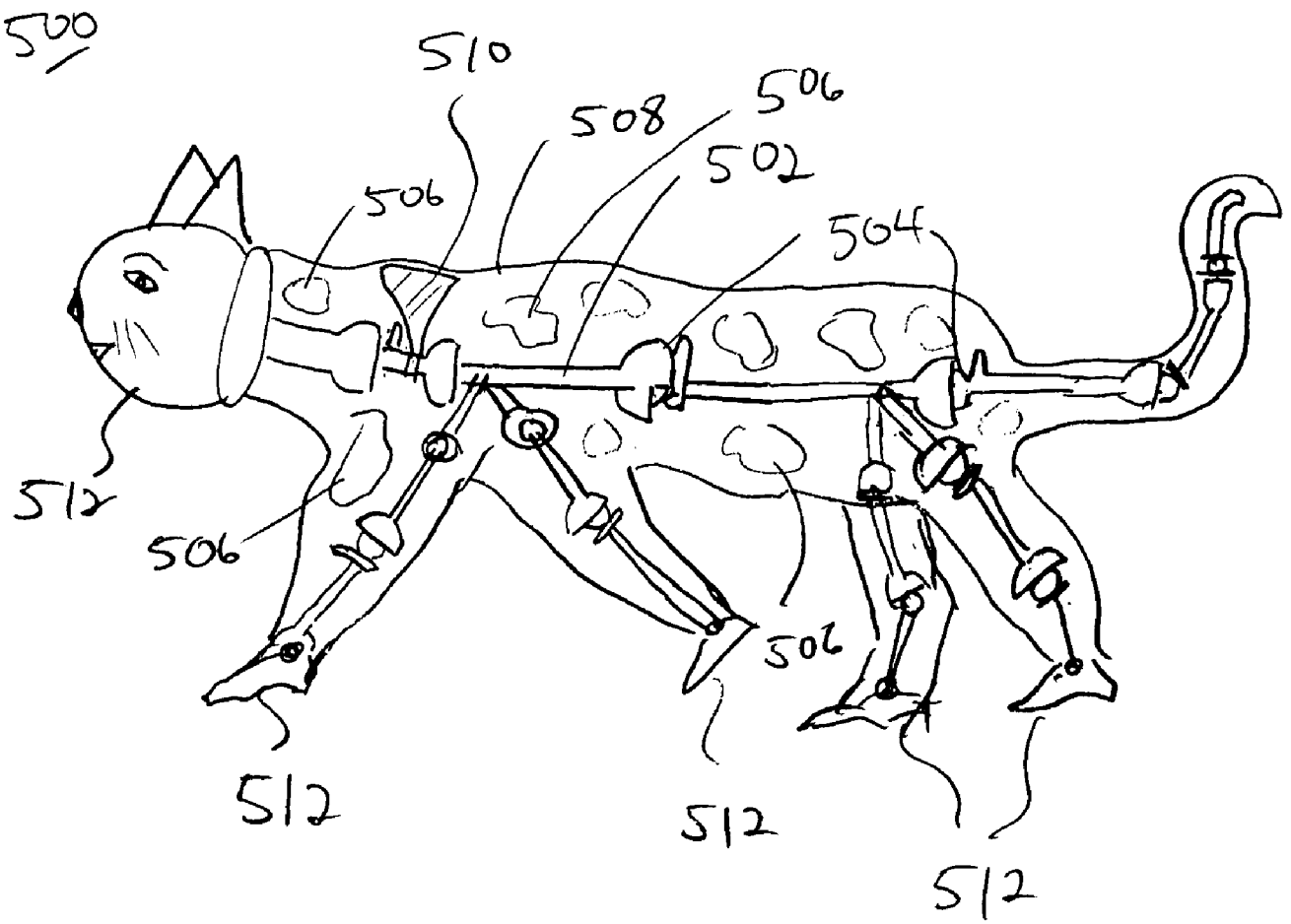
FIG. 6 is a side view of a doll/toy having an infrastructure in accordance with the present invention.

It is preferable that adjacent links are attached by inserting the ball end 18 into the adjacent link's socket end 20 to achieve a rotatable connection (see also e.g., FIG. 6).

Backbone 10 includes a spine 24, which connects a shoulder portion 26 to a hip portion 28. Shoulder portion 26 includes one of a ball end 18 and socket end 20 for each arm 12 and for a neck portion 15. Hip portion 28 includes one of a ball end 18 and socket end 20 for each leg 14. It is to be understood that other connectors or joints may be employed in addition to or instead of ball and socket joints.

In one embodiment, spine 24 includes a flexible rod. The rod includes a resilient material such as a plastic, which is capable of bending in the direction of arrow "A" into or out of the page and twisting in the direction of arrow "B". In this way, relative motion is provided between hip portion 28 and shoulder portion 26, when a force is applied to the skeleton. The flexible spine 24 provides a limited motion for the skeleton and avoids unnatural contortions of the spine 24, which are prevalent in the prior art. In a particularly useful embodiment, spine 24 includes grooves 34 therein, which are preferably longitudinally oriented (see FIG. 1A). These longitudinal grooves 34 provide a reduction in cross-sectional area of spine 24 to permit torsional deflection while maintaining sufficient distances from the neutral axis for portions of the spine 24 such that sufficient bending resistance is maintained. In one embodiment, spine 24 is made from a flexible moldable plastic, such as polypropylene. Other plastics or polymer materials may also be employed.

In other embodiments, spine 24 may be made flat or have a cross-section with an aspect ratio to permit easier bending in a single axis while resisting bending in another axis (see FIG. 1A).

Figure 2:
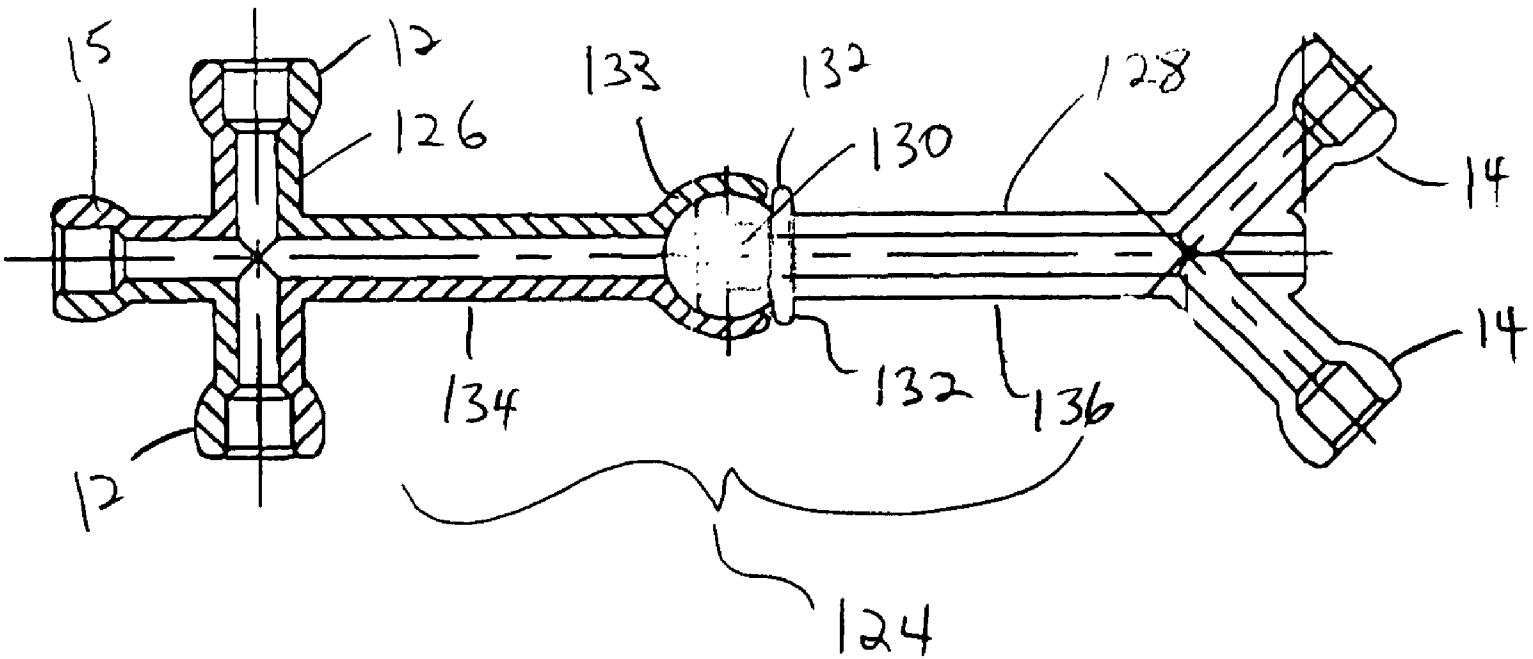
FIG. 2 is a partial cross-sectional view of a spine joint in accordance with one embodiment of the present invention.

Referring to FIG. 2, a spine 124 is provided that includes multiple parts. A shoulder portion 126 is adapted to receive a hip portion 128 (or vice versa) in a socket 133. Hip portion 128 includes a ball 130 and an annular ring 132 which serves to limit a bending motion of shoulder portion 126 relative to hip portion 128, but permits rotation of shoulder portion 126 relative to hip portion 128. In this way, rotational poses may be applied to the doll skeleton. In an alternate embodiment, annual ring 132 may be replaced with a set of pegs, protrusions, a shouldered portion or other increase in width or thickness of the spine portion adjacent to ball 130.

Longitudinal portions 134 and 136 of shoulder 126 and hip portions 128 preferably include longitudinal grooves 34 (as described above with reference to FIGS. 1 and 1A). In this case, grooves 34 maintain bending resistance, but only apply torsional resistance when the rotational motion of spine 124 is limited. Limited spine motion will be described below.

It is to be noted that ball 130 may include a portion of a ball, as long as the joint provides a ball and socket motion. For example, an upper portion of ball 130 may be left off is that upper portion is not needed for engagement with the socket.

Figure 3:
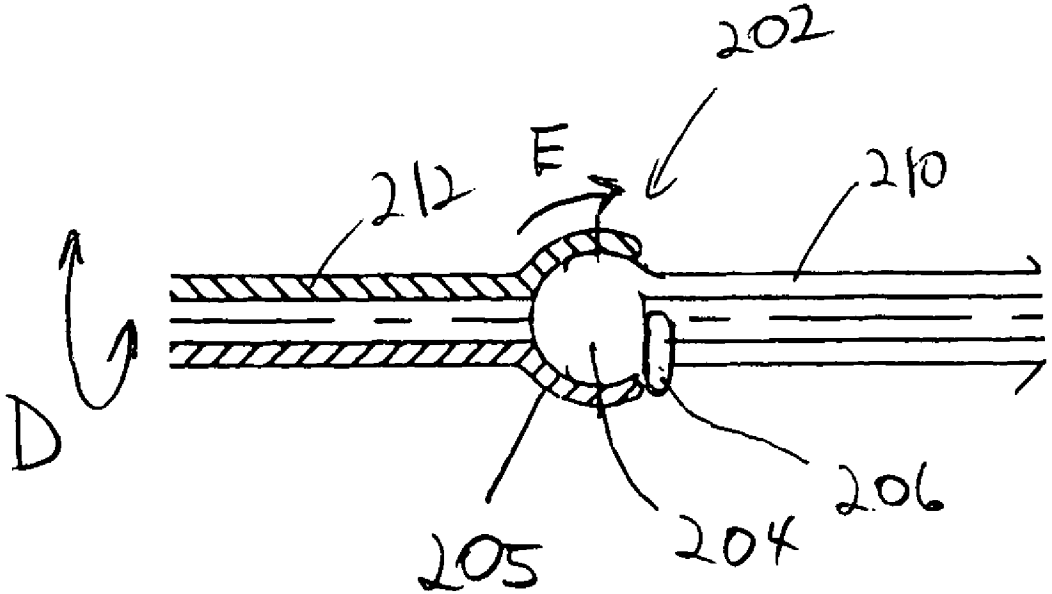
FIG. 3 is a partial cross-sectional view of a skeleton joint providing rotational motion in accordance with another embodiment of the present invention.

Referring to FIG. 3, a spine joint 202 includes a ball 204 and a socket 205. Ball 204 has a ring 206 formed adjacent thereto. Ring 206 may include a plurality of different arrangements. For example, ring 206 may only be formed over a fraction of the circumference of spine 210. In this way, joint 202 may permit rotation (arrow "D") as well as a tilt angle (arrow "C") between spine portions 210 and 212.

In one embodiment, ring 206 exists over a range of the circumference of spine 210 for between about 5 degrees to about 180 degrees. The ring 206 may be oriented to provide a tilting angle "C" to simulate back movements normally permitted by a spine. In addition lateral movements and rotations are permitted. These complex motions can be design into the joint by varying the circumference of spine 210 covered by ring 206.

Figure 4A:
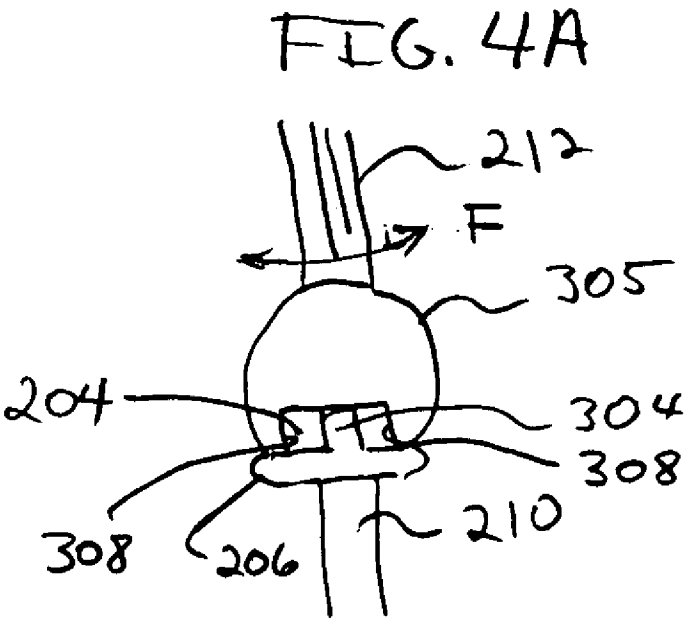
FIG. 4A is a front view of a skeleton joint similar to that in FIG. 4 having rotational limits in accordance with another embodiment of the present invention.
Figure 4:
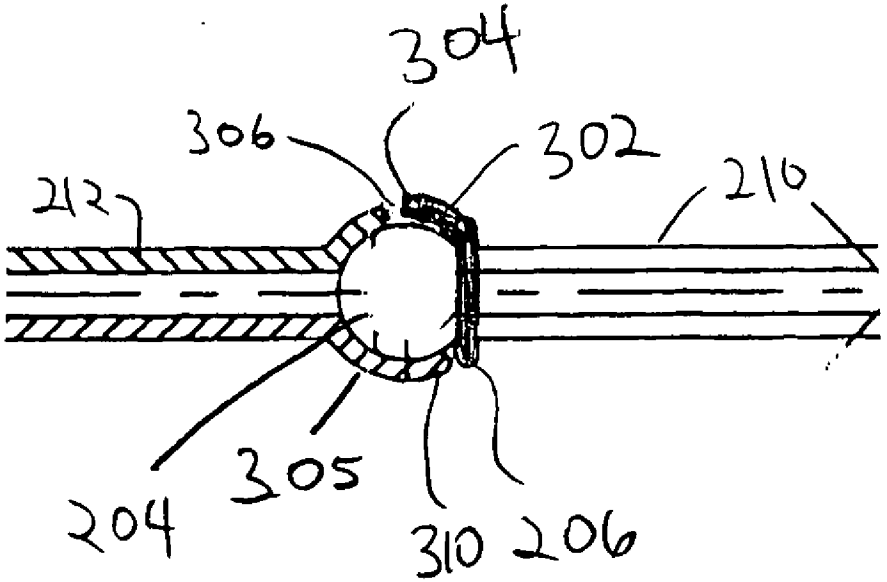
FIG. 4 is a partial cross-sectional view of a skeleton joint having rotational limits in accordance with another embodiment of the present invention.

Referring to FIGS. 4 and 4A, a rotational limiter 302 is provided on ring 206. Limiter 302 may include a protrusion or protrusions 304 formed on ring 206 or formed directly on spine. In FIG. 4, socket 305 includes an open slot 306 which when assembled on ball 204 permits protrusion 304 to fit therein. Protrusion 304 corresponds to slot 306 and permits rotation between socket 205 and ball 204 until a sidewall 308 of slot 306 is encountered by protrusion 304 during rotation. Once encountered, engagement of protrusion 304 and slot 306 prevent further rotation in the direction that caused engagement between the parts. Likewise, if rotated in the opposite direction, engagement between an opposite sidewall 308 of slot 306 and protrusion 304 will occur thereby limiting relative rotational motion between socket 305 and ball 204.

Slot 306 may extend about the circumference of socket 305 from between about 0 degrees to about 170 degrees. A lower portion 310 of socket 305 should engage ring 206 around ball 204 to permit a stable joint that does not permit tilting between adjacent spine sections 210 and 212. Motion permitted is rotational as indicated by arrow "F".

Figure 5A:
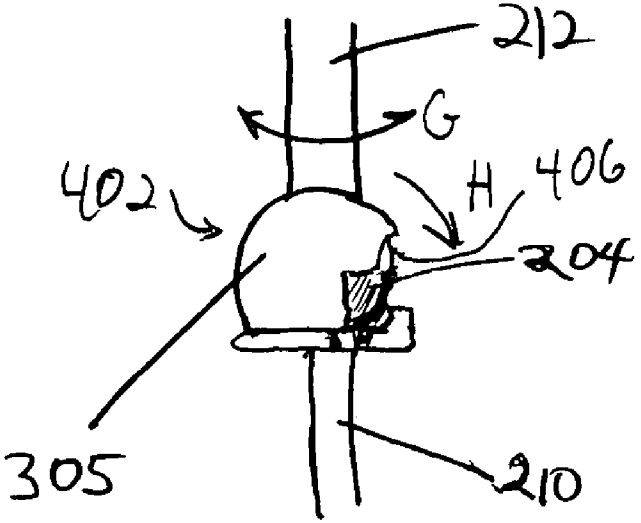
FIG. 5A is a front view of a skeleton joint similar to that in FIG. 5 having rotational and bending limits in accordance with another embodiment of the present invention.
Figure 5:
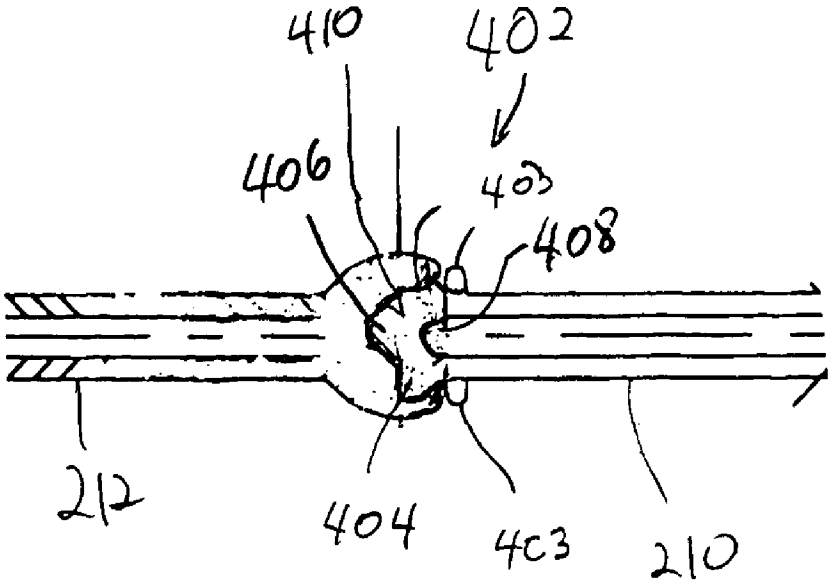
FIG. 5 is a partial cross-sectional view of a skeleton joint having rotational and bending limits in accordance with another embodiment of the present invention.

Referring to FIGS. 5 and 5A, a combined joint 402 includes the features described with reference to FIGS. 3 and 4. Joint 402 includes an open slot 404. Slot 404 includes an opening 406 configured to permit an additional range of motion to the joint 402. In this way, a protrusion or protrusions 408 can be maneuvered in the available space in slot 404 to permit a pre-determined motion for joint 402 in the directions of arrows "G" and "H". Protrusions 403 and 408 may be formed as a portion of ring 206 as described earlier or may take the form of a geometric shape that provides support as well as limitations on the movement of joint 402.

In one embodiment, protrusion 408 may include rounded edges to permit a smooth engagement with walls 410 of slot 404. An exemplary embodiment includes slot 404 formed as a complex shape to permit joint 402 to bend forward, say up to about 30 degrees, permit rotation from left to right of about 90 degrees (extreme-to-extreme) about the axis of spine 212. All other motions of joint 402 are prevented. However, if spine 210 and 212 are formed from a resilient bendable/twistable material then an additional deflection can be temporarily achieved to permit additional motion of the skeleton.

It is to be understood that the joints described herein may be employed in any joint of a doll or toy. For example, joint 402 may be employed in a knee joint, elbow joint, ankle joint, neck joint, shoulder joint, tail joint or any other joint. The joints may be employed in any toy, and are particularly useful in toys or dolls where the skeleton is hidden from view by an outer layer of fabric, rubber or other suitable material.

Referring to FIG. 6, a doll or stuffed animal 500 includes an internal skeleton 502 having joints 504 in accordance with the present invention. Skeleton 500 includes joints 504, which may include a combination of joints as described above. A covering 508 that may include a fabric, plastic, rubber or other skin or fur-like material covers skeleton 502. An optional stuffing material 506 may be provided to fill out covering 508. In addition, spacers or fillers 510 may be employed to further fill out covering 508 or to provide a predetermined shape to doll 500. Spacers 510 may be attached to skeleton 502 or be permitted to float freely within skeleton 502.

Other features 512 may be attached to skeleton or infrastructure 502. These features 512 may be internal or external to covering 508. For example, features 512 may include hands, feet, a head, wings, or other features of the doll or animal 500.

Having described preferred embodiments for doll and infrastructures therein (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. A doll, comprising:

an infrastructure which permits relative motion of portions of the doll and an ability to pose portions of the doll, the infrastructure comprising:

body parts wherein at least one body part includes a first member including at least a portion of a ball;

a second member including a socket which receives the at least a portion of the ball;

a protrusion formed on the first member adjacent to the ball such that when the ball is received in the socket a rotation about a longitudinal axis of the first member is permitted while restricting an angular change between a longitudinal axis of the second member and the longitudinal axis of the first member.

2. The doll as recited in claim 1, wherein the protrusion extends about an entire circumference of the first member and prevents an angular change between the longitudinal axis of the second member and the longitudinal axis of the first member.

3. The doll as recited in claim 1, wherein the protrusion extends about a portion of a circumference of the first member and permits an angular change between the longitudinal axis of the second member and the longitudinal axis of the first member in a range of motion.

4. The doll as recited in claim 1, wherein the socket includes a slot, which receives a portion of the protrusion to permit an angular change between the longitudinal axis of the second member and the longitudinal axis of the first member.

5. The doll as recited in claim 1, wherein the slot is dimensioned and configured to define a range of motion permitted for a joint formed by the at least a portion of the ball and the socket.

6. The doll as recited in claim 1, wherein the first member includes longitudinal grooves.

7. The doll as recited in claim 1, wherein the second member includes longitudinal grooves.

8. The doll as recited in claim 1, wherein the first member and second member provide continuous flexure over their length.

9. The doll as recited in claim 1, further comprising an outer covering into which the infrastructure is disposed.

10. The doll as recited in claim 9, further comprising stuffing material for filling the outer covering.

11. The doll as recited in claim 9, further comprising features which connect to the infrastructure to provide one of a predetermined shape for the covering and an external feature of the doll.

12. The doll as recited in claim 1, wherein the protrusion includes at least a portion extending beyond an opening of the socket.

13. A doll, comprising:

an infrastructure which permits relative motion of portions of the doll and an ability to pose portions of the doll, the infrastructure comprising:

body parts wherein at least one body part includes a first member including at least a portion of a ball;

a second member including a socket which receives the at least a portion of the ball;

a protrusion formed on the first member adjacent to the ball, the protrusion having at least a portion extending beyond an opening of the socket such that when the ball is received in the socket a rotation about a longitudinal axis of the first member is permitted while restricting an angular change between a longitudinal axis of the second member and the longitudinal axis of the first member.

* * * * *